United States Patent [19]

Williams

[11] 4,015,683

[45] Apr. 5, 1977

[54] NOISE SUPPRESSOR FOR VACUUM SWEEPER AND THE LIKE

[75] Inventor: William H. Williams, Rancho Palos Verdes, Calif.

[73] Assignee: Purex Corporation Ltd., Lakewood, Calif.

[22] Filed: Dec. 29, 1975

[21] Appl. No.: 644,932

[52] U.S. Cl. ..... 181/36 R; 15/326; 181/36 A; 181/33 K

[51] Int. Cl.² ..... F01N 3/06; A47L 5/00

[58] Field of Search ..... 181/36 A, 36 D, 42, 181/36 R, 35 R, 33 K; 15/326

[56] References Cited

UNITED STATES PATENTS

| | | | |
|---|---|---|---|
| 2,253,310 | 8/1941 | Smellie | 15/326 |
| 2,328,236 | 8/1943 | Stoner | 15/326 |
| 3,638,755 | 2/1972 | Sack | 181/36 R |
| 3,757,891 | 9/1973 | Krieger | 181/36 A |
| 3,842,932 | 10/1974 | Gibel | 181/42 |

*Primary Examiner*—Stephen J. Tomsky
*Attorney, Agent, or Firm*—H. Calvin White

[57] ABSTRACT

A noise suppressor package attachable to air exhaust tubing comprises:

a. annular body means defining an axially extending bore to pass said exhaust, said body means including compressible foam segments which project radially inwardly at said bore, said segments being axially elongated and circularly spaced, and b. a tubular cover extending about said body means and having a flexible neck at one end of said body means, said neck being radially constrictable about said exhaust tubing to retain the package to the tubing.

10 Claims, 6 Drawing Figures

NOISE SUPPRESSOR FOR VACUUM SWEEPER AND THE LIKE

BACKGROUND OF THE INVENTION

This invention relates generally to the reduction of objectionable noise levels associated with exhausting of air from devices employing blowers or fans; more particularly it concerns an unusually advantageous muffler construction adapted to use with such devices, as for example vacuum sweepers, floor scrubbers and carpet maintenance equipment.

Prior air discharge mufflers have suffered from many disadvantages. Among these were the creation of objectionable back pressure which reduces the overall efficiency of the applicance, corrosion or oxidation of the muffler components, injury to furniture or other equipment with which the muffler may come in contact; and insufficient noise suppression.

SUMMARY OF THE INVENTION

It is a major object of the invention to provide an improved muffler overcoming the above listed problems and disadvantages, and also affording many additional advantages. The latter include light weight, low-cost construction, and ease of attachment to, and detachment from, the appliance air discharge tubing.

Basically, the noise suppressor comprises:

a. annular body means defining an axially extending bore to pass the exhaust, the body means including compressible foam segments which project radially inwardly at the bore, the segments being axially elongated and circularly spaced, and b. a tubular cover extending about the body means and having a flexible neck at one end of the body means, the neck being radially inwardly constrictable about the vacuum sweeper exhaust tubing to retain the package to the tubing.

As will be seen, the body means may comprise at least one annulus of acoustical, compressible foam material, the segments being integral with that annulus or annuli; a foam collar may be provided at one end of the body means to receive an end portion of the tubing in an enlarged bore provided by the collar, and so that optimum muffling effect is provided when air discharges into grooves provided between the segments; and the cover flexible neck may comprise flexible loops constrictable by a draw-string about the tubing end portion to retain the package to the tubing so that any vibration is cushioned and transmitted noiselessly to the loops, collar and body means.

These and other objects and advantages of the invention, as well as the details of an illustrative embodiment, will be more fully understood from the following description and drawings, in which:

DRAWING DESCRIPTION

DETAILED DESCRIPTION

Figure 1:
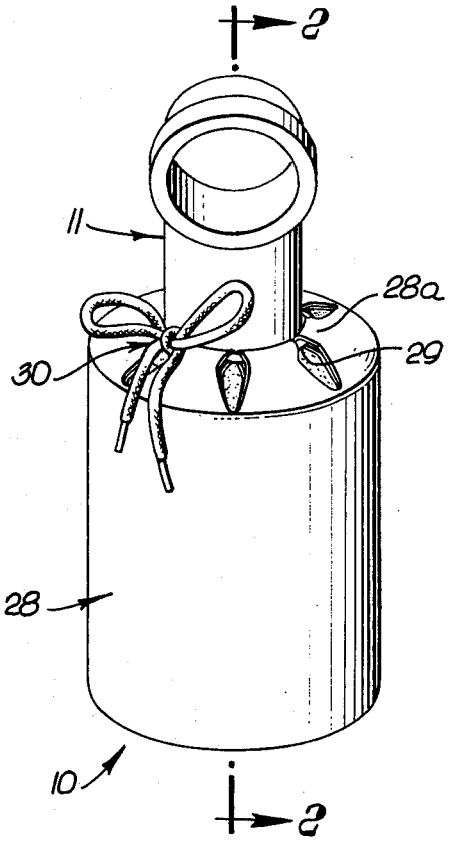
FIG. 1 is a perspective showing of a noise suppressor package embodying the invention, and attached to a vacuum sweeper discharge.
Figure 2:
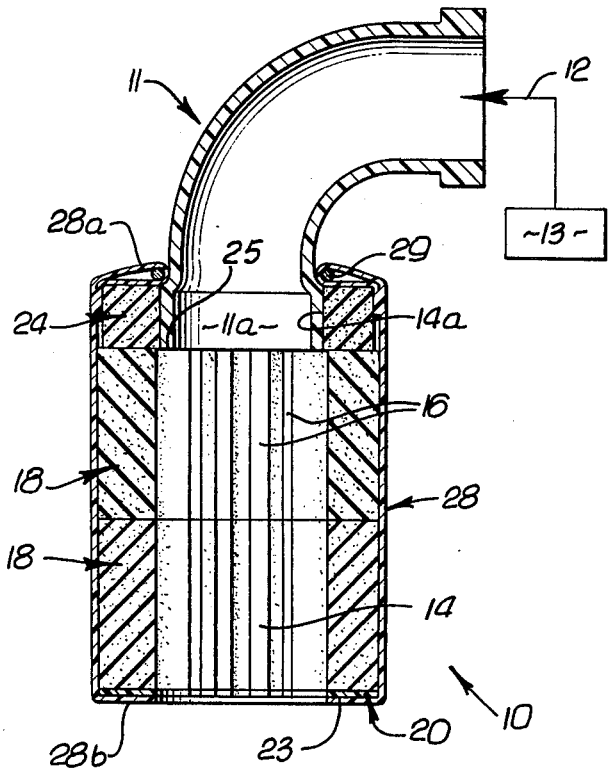
FIG. 2 is a vertical elevation taken in section on lines 2—2 of FIG. 1.
Figure 3:
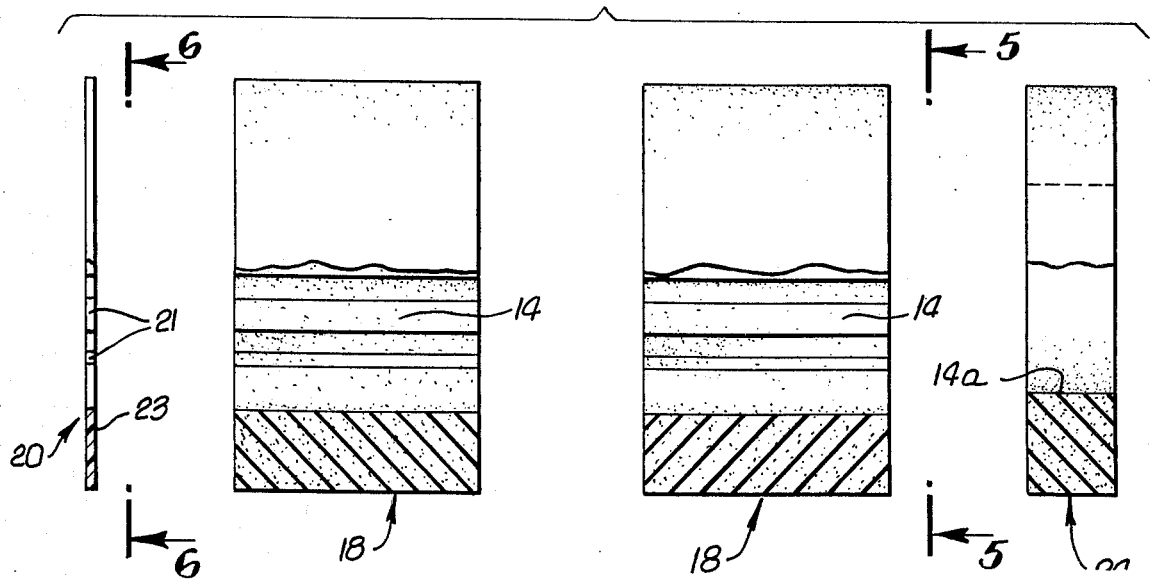
FIG. 3 is an enlarged axially exploded view of components of the package.
Figure 4:
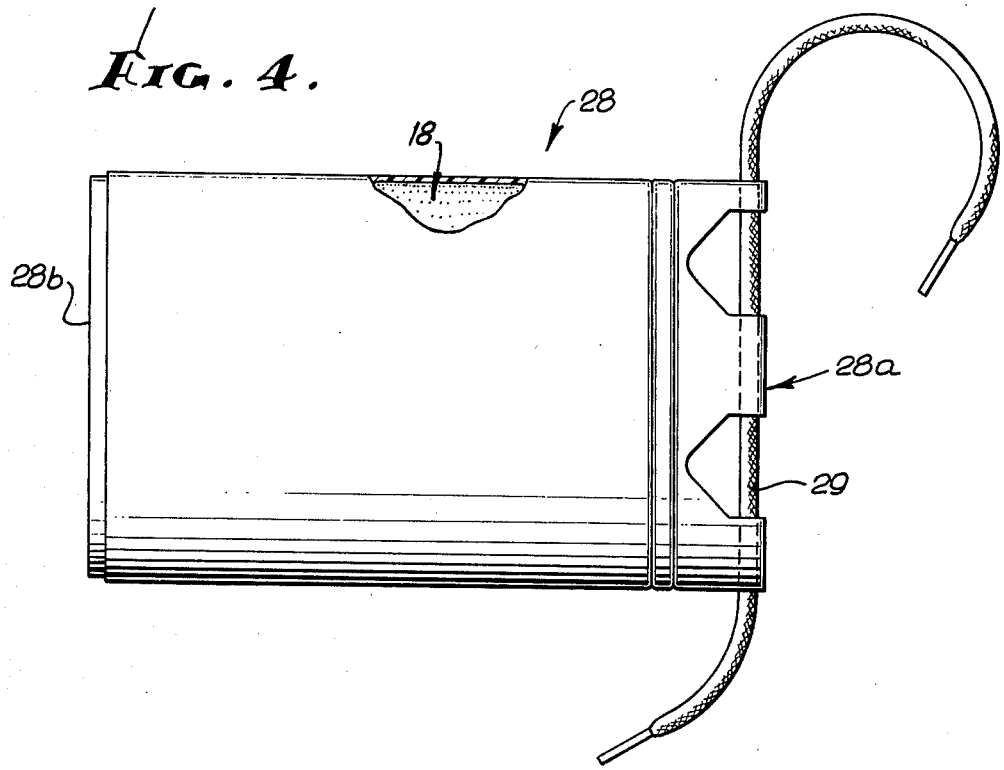
FIG. 4 is an enlarged side elevation of the package cover, prior to constriction of its flexible neck.
Figure 5:
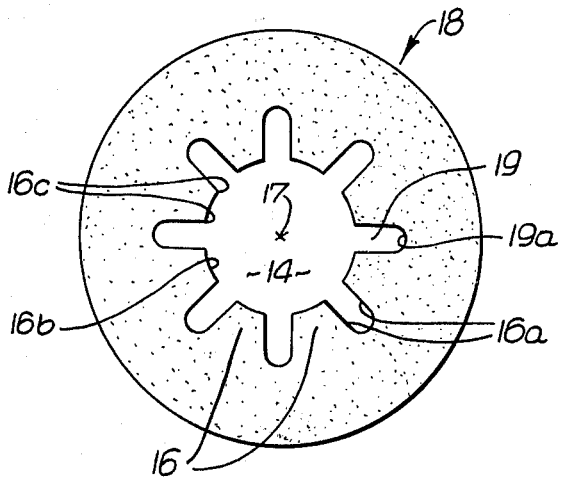
FIG. 5 is a fragmentary elevation taken on lines 5—5 of FIG. 3.
Figure 6:
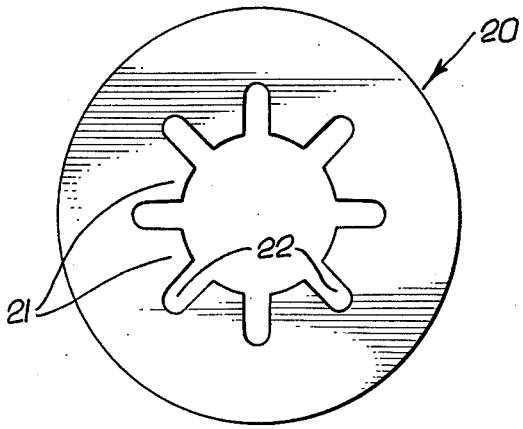
FIG. 6 is a fragmentary elevation taken on lines 6—6 of FIG. 3.

FIGS. 1 and 2 show an unusually advantageous example 10 of the vacuum sweeper exhaust noise suppressor package removably attached to exhaust tubing 11 so as to be readily disposable and replaceable. The tubing may comprise an elbow having an inlet receiving at 12 the air exhaust discharge of the sweeper, generally indicated at 13. The tubular elbow has an enlarged annular discharge end portion **11*a* received in the package, as for example bore enlargement 14*a***.

The package itself in general comprises annular body means defining an axially extending bore 14 to pass the exhaust air flow, the sound wave content of which is to be suppressed or muffled. In this regard, muffling action is substantially aided by the provision of compressible foam segments, as for example at 16, which project radially inwardly at the bore, the segments being axially elongated and circularly spaced about the bore axis 17.

In the example, the body means comprises two annular bodies 18 of acoustical resiliently compressive foam material, one example being polyester grade polyurethane plastic material, of about 2 pounds per cubic foot density. Other similar materials may be used. The two bodies integrally include the segments 16 which are shown to have trapezoidal cross sections in planes normal to axis 17. The opposite planar side walls **16*a* of adjacent sections 16 are circularly spaced apart to form radially extending, longitudinally axially elongated slots or grooves 19, whose radially outer peripheries 19*a* are concave toward axis 17. Contrariwise, the radially innermost surfaces 16*b* of the sections 16 are subtantially flat, and meet the walls 16*a* at sharp corners 16*c*. The widths of the flats 16*b* are between one and two times the widths of the grooves 19, and the groove radial depths are between one and two times the widths of the flats 16*b*, for best results. Note that the grooves 19 extend axially throughout the lengths of the bodies 18, and are in axial alighment. Note further, that the sections 16 protrude into the path of exhaust air flow through the package, so that the flow is deflected into the grooves 19 and around and along sections 16,** thereby to enhance turbulant flow conditions, with accompanying muffling of the sound waves by the foam structure, and without creating objectionable back pressure. The latter otherwise would reduce the efficiency of the sweeper.

A relatively hard plastic base plate 20 is provided at the discharge end of the package, the plate having ring shaped with radial segments 21 and grooves 22 therebetween which are in axial alighment with the segments 16 and grooves 19, respectively. Ring 20 may be adhesively bonded to the discharge end of adjacent body 18, at the location 23.

The illustrated body means also includes a plastic foam annular collar 24 which defines bore **14*a*, the latter being enlarged relative to bore 14, i.e. offset radially outwardly of a cylinder defined by the segment radially innermost extents, i.e. flats 16*b*. The bore is sized or adapted to receive the tubing enlargement 11*a* which may seat endwise against step or stop shoulder 25. Any vibration of the tubing 11 is cushioned and noiselessly transmitted to the foam elements 24 and 18.**

An important feature of the invention concerns the provision of a tubular cover extending about the body elements, as for example to hold them in assembled relation. In this regard, collar 24 need not be bonded to adjacent body 18, and may be conveniently formed separately from the forming of bodies 18. The illustrated cover 28 may consist of a flexible plastic sleeve, one example being 25 mil polyvinylchloride sheet material.

The cover 28 has a flexible neck at one end of the package, and formed so as to be radially inwardly constrictable about the sweeper tubing 11, to releasably retain the package to that tubing. The neck may with unusual advantage be defined by circularly spaced or arranged, generally radially inwardly extending loops 28*a* which may be pulled or urged into engagement with the tubing as seen in FIG. 2, to thereby axially confine the tubing enlargement 11*a* between shoulder 25 and the loops, any vibration transmitted to the loops being cushioned and damped. A draw-string is shown at 29 extending through the loops, the opposite ends of the string being tied in a knot as at 30 in FIG. 1, to hold the loops in retaining position, the knot being easily untied when package replacement is desired.

The opposite end 28*b* of the cover annularly overlaps and extends adjacent the end face of the support plate 20, to hold the plate and bodies 18 in assembled relation.

Accordingly, a simple, low-cost lightweight, highly effective, and replaceable muffler for a vacuum sweeper discharge is provided. Further, the materials of this muffler are non-corrosive and non-reactive and they are soft, i.e. compressible so that the muffler will not damage furniture or other items with which it comes in contact. It is seen to have utility when attached to air discharging vacuum sweepers, floor scrubbers, and carpet maintenance equipment, for example.

I claim:

1. In a noise suppressor package attachable to air exhaust tubing, the combination comrising:

a. annular body means defining an axially extending bore to pass said exhaust, said body means including compressible foam segments which project radially inwardly at said bore, said segments being axially elongated and circularly spaced, and b. a tubular cover extending about said body means and having a flexible neck at one end of said body means, said neck being radially inwardly constrictable about said exhaust tubing to retain the package to the tubing.

2. The combination of claim 1 wherein said body means comprises at least one annulus consisting of acoustical compressible foam material.

3. The combination of claim 1 wherein said body means includes multiple annuli consisting of compressible plastic foam, said segments integral with said annuli.

4. The combination of claim 3 wherein said body means includes a plastic foam annular collar at said one end of the body means, said collar having a bore which is offset radially outwardly of a cylinder defined by the radially innermost extents of said segments, said bore adapted to receive an end portion of said tubing.

5. The combination of claim 4 including said tubing whose end portion is enlarged and received in said bore, said cover flexible neck radially constricted about said tubing axially endwise of said enlarged end portion.

6. The combination of claim 5 wherein said flexible neck is defined by circularly arranged, generally radially inwardly extending loops, and a draw-string extending through said loops and tightened to retain said loops to said tubing.

7. The combination of claim 6 wherein the cover consists of a flexible plastic sleeve.

8. The combination of claim 1 wherein said flexible neck is defined by circularly arranged, generally radially inwardly extending loops, and a draw-string extending through said loops to be tightened about the tubing for retaining the loops to the tubing, the cover consisting of a flexible plastic sleeve.

9. The combination of claim 7 including an annular base plate at the opposite end of said body means, said cover enveloping said plate at said opposite end.

10. The combination of claim 1 including a vacuum sweeper whose discharge communicates with said tubing.

* * * * *